US009689581B2

(12) United States Patent
Zakula et al.

(10) Patent No.: US 9,689,581 B2
(45) Date of Patent: Jun. 27, 2017

(54) VENTILATION SYSTEM AND METHOD

(71) Applicant: Broan-NuTone LLC, Hartford, WI (US)

(72) Inventors: Mirko Zakula, New Berlin, WI (US); Robert G. Penlesky, Waukesha, WI (US); Daniel L. Karst, Beaver Dam, WI (US); Kenneth J. Jonas, Mequon, WI (US)

(73) Assignee: Broan-NuTune LLC, Hartford, WI (US)

( * ) Notice: Subject to any disclaimer, the term of this patent is extended or adjusted under 35 U.S.C. 154(b) by 540 days.

(21) Appl. No.: 14/175,265

(22) Filed: Feb. 7, 2014

(65) Prior Publication Data

US 2015/0226443 A1 Aug. 13, 2015

(51) Int. Cl.
*F24F 7/06* (2006.01)
*F04D 13/06* (2006.01)
(Continued)

(52) U.S. Cl.
CPC ..... *F24F 7/065* (2013.01); *F04D 13/0686* (2013.01); *F04D 25/08* (2013.01);
(Continued)

(58) Field of Classification Search
CPC .. F04D 13/0686; F04D 25/08; F04D 29/4226; F04D 29/61; F24F 7/007; F24F 13/20; F24F 7/065; F24F 2013/205
(Continued)

(56) References Cited

U.S. PATENT DOCUMENTS 6,488,579 B2 * 12/2002 Larson ..... F24F 7/007 415/204
9,022,846 B1 * 5/2015 Tom ..... F24F 7/007 454/338

(Continued)

OTHER PUBLICATIONS

"Canadian Application Serial No. 2,847,911, Amendment filed Jan. 22, 2016 in response to Office Action mailed Jul. 23, 2015", 20 pgs.

(Continued)

*Primary Examiner* — Gregory Huson
*Assistant Examiner* — Dana Tighe
(74) *Attorney, Agent, or Firm* — McDermott Will and Emery LLP

(57) ABSTRACT

Some embodiments of the invention include a ventilation apparatus including a housing assembly with at least one fluid inlet, and at least one fluid outlet, and an exhaust fan assembly coupled to the housing assembly within an inner region. The exhaust fan assembly can include a scroll positioned within and coupled to the main housing, and a blower wheel positioned within the scroll and mechanically coupled to the motor. The ventilation assembly can include a configurable mounting panel including a main panel and at least one tab, and at least one configurable flange coupled to the main panel and extending outwardly from the main panel. The configurable mounting panel can include at least one bending region with at least one aperture. The ventilation apparatus can also include a muffler including an aperture, an electrical box enclosure including a lid, and a duct connector assembly each coupled with the housing assembly.

20 Claims, 7 Drawing Sheets

(51) Int. Cl.

| | |
|---|---|
| ***F04D 25/08*** | (2006.01) |
| ***F04D 29/42*** | (2006.01) |
| ***F04D 29/60*** | (2006.01) |
| ***F24F 7/007*** | (2006.01) |
| ***F24F 13/20*** | (2006.01) |

(52) U.S. Cl.
CPC ..... *F04D 29/4226* (2013.01); *F04D 29/601* (2013.01); *F24F 7/007* (2013.01); *F24F 13/20* (2013.01); *F24F 2013/205* (2013.01)

(58) Field of Classification Search
USPC ..... 454/237, 249, 258, 309, 342, 346
See application file for complete search history.

(56) References Cited

U.S. PATENT DOCUMENTS

| | | | | |
|---|---|---|---|---|
| 9,097,265 | B1 * | 8/2015 | Tom | F04D 29/626 |
| 2005/0117341 | A1 * | 6/2005 | Craw | F21V 29/02 362/253 |
| 2007/0071618 | A1 * | 3/2007 | Rhoads | F04D 25/0613 417/423.1 |
| 2007/0131827 | A1 * | 6/2007 | Nevers | F21V 21/04 248/201 |
| 2009/0170421 | A1 * | 7/2009 | Adrian | F24F 7/06 454/349 |

OTHER PUBLICATIONS

"Canadian Application Serial No. 2,847,911, Office Action mailed Jul. 23, 2015", 4 pgs.

* cited by examiner

VENTILATION SYSTEM AND METHOD

BACKGROUND

Ventilating exhaust fans, such as those typically installed in bathrooms, draw air from within an area and pass the exhausted air out to another location, such as through a vent in the gable or roof of a home or other building structure. Centrifugal exhaust fans typically include a rotating fan wheel having a plurality of vanes that create an outward airflow which, in turn, is directed out of an outlet opening. The fan wheel is typically coupled to a motor supported within the fan housing, and the motor drives the fan wheel, thus providing ventilation to an area. In some cases, a curved fan scroll is employed to channel air around the fan, and can be defined by a housing wall of the fan or by a separate element or structure within the fan housing.

Many typical ventilating exhaust fan assemblies currently in use include a housing positioned within a building structure, such as in an aperture in a wall or ceiling. The housing is generally secured in the aperture in a number of conventional manners, such as by being attached to wall or ceiling joists, or by being attached to other structures in the wall or ceiling. In some cases, it may be desirable to replace an exhaust fan within a building or structure. For example, an old exhaust fan may need to be replaced when broken or malfunctioning, or it may be desirable to replace an old exhaust fan with one that is more powerful, or has one or more features or characteristics different than the existing exhaust fan. However, conventional exhaust fans can be relatively difficult and time consuming to remove and replace due, in part, to conventional coupling assemblies. Typically, these assemblies require additional parts that require alignment and attachment to the housing, and offer limited ability to be configured for clearance or maneuverability within a pre-existing aperture and/or mounting to a structure in a wall or ceiling.

SUMMARY

Some embodiments of the invention include a ventilation apparatus comprising a housing assembly including a main housing comprising a plurality of sides including at least a first side coupled to a second side and at least partially enclosing an inner region. In some embodiments, the housing assembly can include at least one fluid inlet for receiving fluid from a surrounding environment, and at least one fluid outlet positioned through the first side of the main housing. In some embodiments, the ventilation apparatus can include an exhaust fan assembly coupled to the housing assembly within the inner region. The exhaust fan assembly can comprise a scroll positioned within and coupled to the main housing, and a blower wheel positioned within the scroll and mechanically coupled to the motor and capable of generating a fluid flow within the scroll. In some embodiments, the ventilation assembly can include a configurable mounting panel coupled to at least one of the plurality of sides. The configurable mounting panel can comprise a main panel and at least one tab and at least one configurable flange coupled to the main panel and extending outwardly from the main panel. In some embodiments, the configurable mounting panel can include at least one bending region coupled between the main panel and the at least one configurable flange. Some embodiments of the invention include at least one bending region comprising at least one aperture.

In some embodiments, the ventilation apparatus further comprises a muffler including an aperture. The muffler can be positioned within and coupled to the housing assembly. In some embodiments, the muffler includes a top panel top side and a bottom side and an outer periphery region around the muffler aperture. In some embodiments, the outer periphery region comprises a substantially convex surface on the top side, and a substantially concave surface on the bottom side. Some embodiments include a muffler that includes a plurality of structural ridges coupled to the substantially concave surface in the bottom side. In some other embodiments, the muffler further includes a plurality of fastening mounts configured and arranged to be capable of coupling the muffler to the exhaust assembly and the main housing assembly.

In some embodiments, the configurable mounting panel is coupled to the second side, and in some further embodiments, the second side comprises the configurable mounting panel. Some embodiments of the invention include a ventilation assembly that includes a configurable mounting panel including at least one mounting aperture. In some further embodiments, the configurable mounting panel includes a first configurable flange and a second configurable flange. In some embodiments, the first configurable flange and the second configurable flange each comprise at least one mounting aperture. In some other embodiments, the first configurable flange and the second configurable flange each further comprise an aperture.

Some embodiments of the invention include a ventilation apparatus comprising at least one electrical box enclosure. In some embodiments, the at least one electrical box enclosure includes at least two anchoring flanges. The electrical box enclosure is secured to the housing assembly and a first anchoring flange couples with a third side of the main housing, and a second anchoring flange couples with a fourth side of the main housing.

In some embodiments, the at least one electrical box enclosure includes an electrical box cover plate. Further, some embodiments include an electrical box cover plate that is secured to the electrical box enclosure using at least one screw.

In some embodiments, the electrical box cover plate further comprises a lifting tab. In some embodiments, the electrical box cover plate can be at least partially opened by pivoting the plate about an edge by applying a lifting force to the lifting tab following loosening and removal of the screw.

Some embodiments of the invention include a ventilation apparatus comprising a housing assembly including at least one fluid inlet for receiving fluid from a surrounding environment and a main housing comprising at least a first side coupled to a second side comprising a configurable mounting panel. A fluid outlet is positioned through the first side of the main housing, and an exhaust fan assembly comprising a scroll is positioned within and coupled to the main housing, a blower wheel is positioned within the scroll and mechanically coupled to the motor and capable of generating a fluid flow within the scroll and fluid discharge through the fluid outlet. The configurable mounting panel can comprise a main panel, at least one tab, and at least one configurable flange coupled to and extending outwardly from the main panel. The configurable mounting panel can comprise at least one bending region comprising at least one aperture coupled between the main panel and the at least one configurable flange, and a muffler including an aperture, the muffler positioned within and coupled to the housing assembly. An electrical box enclosure can be coupled within the main housing, and a duct connector assembly can be coupled to the first side.

DETAILED DESCRIPTION

Figure 1:
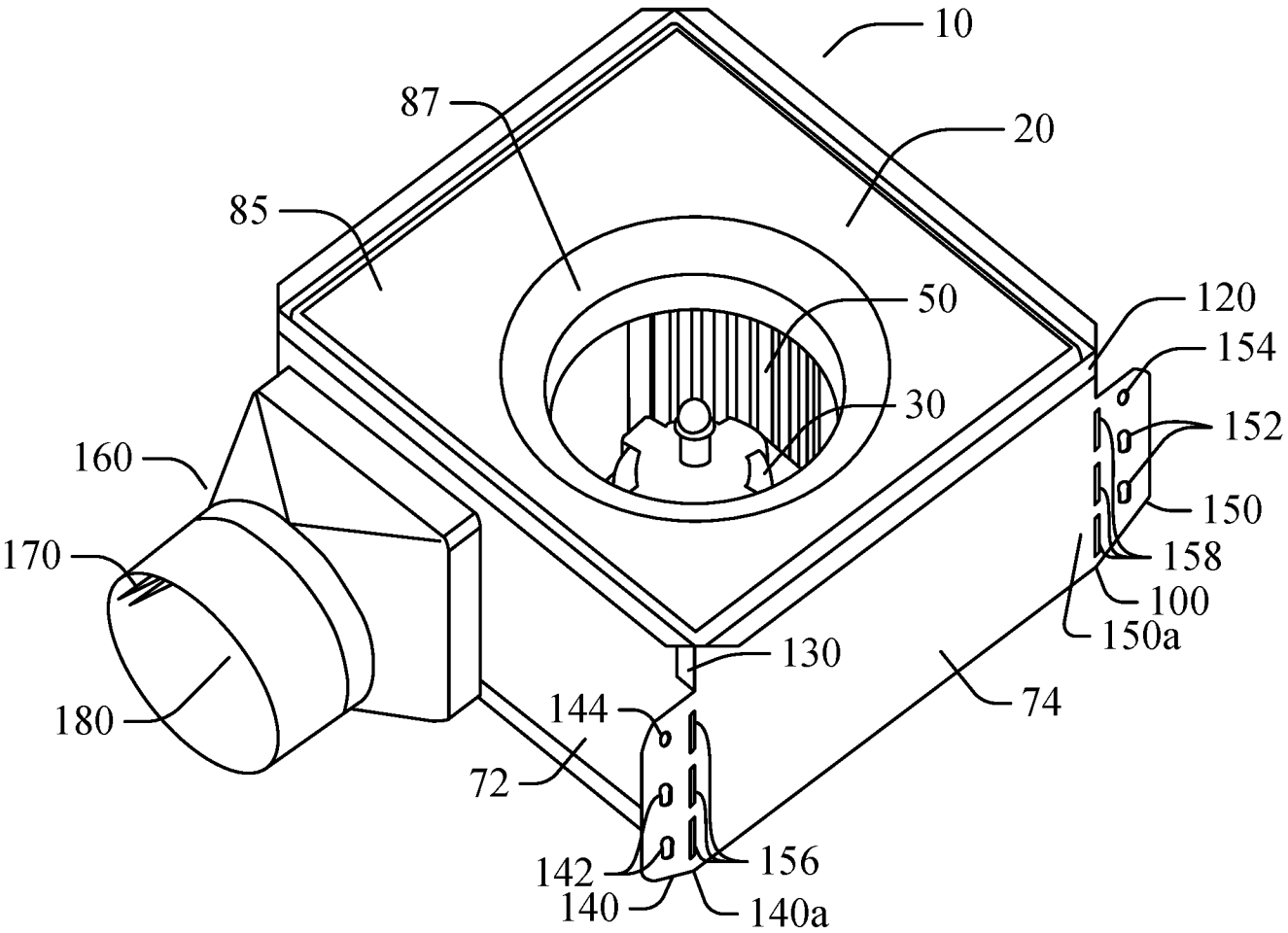
FIG. 1 is a front perspective view of a ventilation assembly according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives that fall within the scope of embodiments of the invention.

Figure 2:
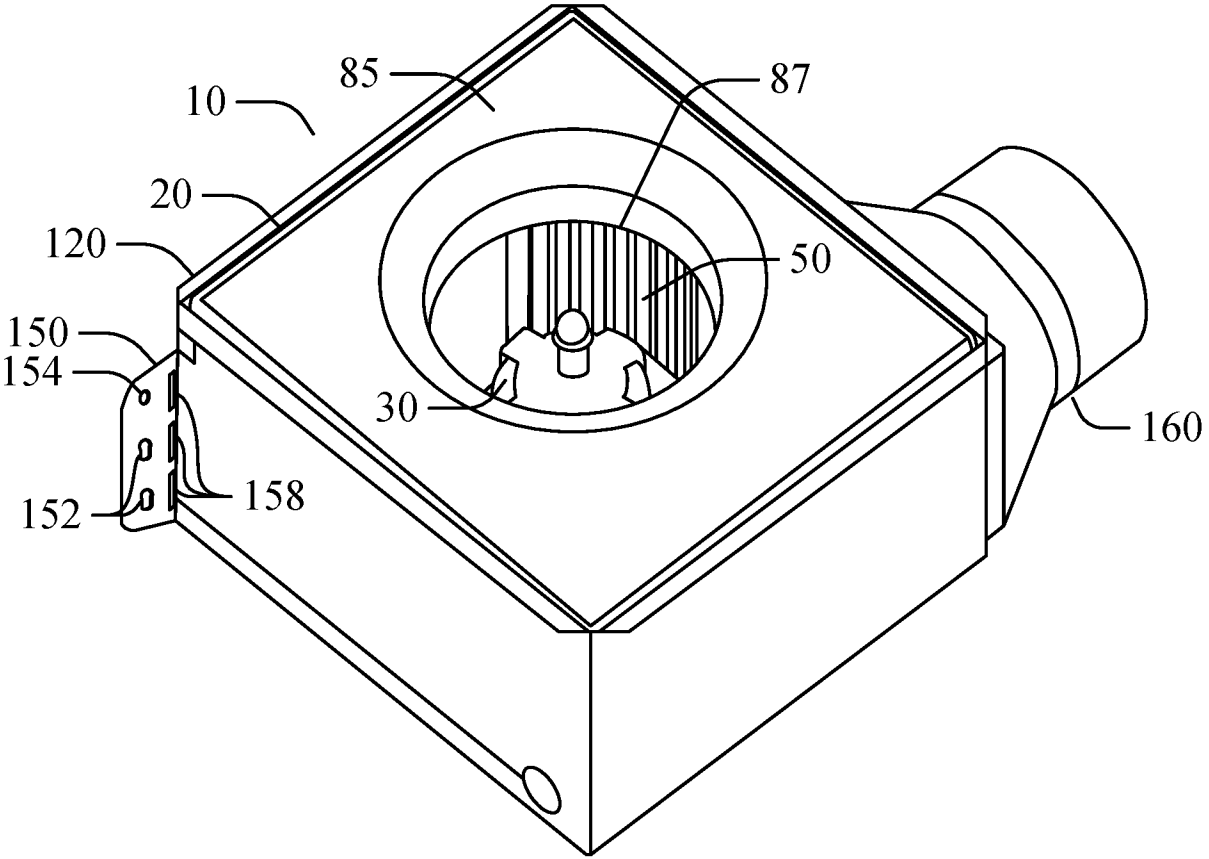
FIG. 2 is a rear perspective view of a ventilation assembly according to one embodiment of the invention.

FIG. 1 is a front perspective view of a ventilation assembly 10, and FIG. 2 is a rear perspective view of a ventilation assembly 10 according to one embodiment of the invention. As shown, some embodiments of the ventilation assembly 10 can include several components and devices that can perform various functions. In some embodiments, the ventilation assembly can include a housing assembly 25 including a main housing 27 which can house the various components and devices of the ventilation assembly 10, some of which may be coupled with or integral to sides 72, 74, 76, and/or 78 of the main housing 27.

Figure 3:
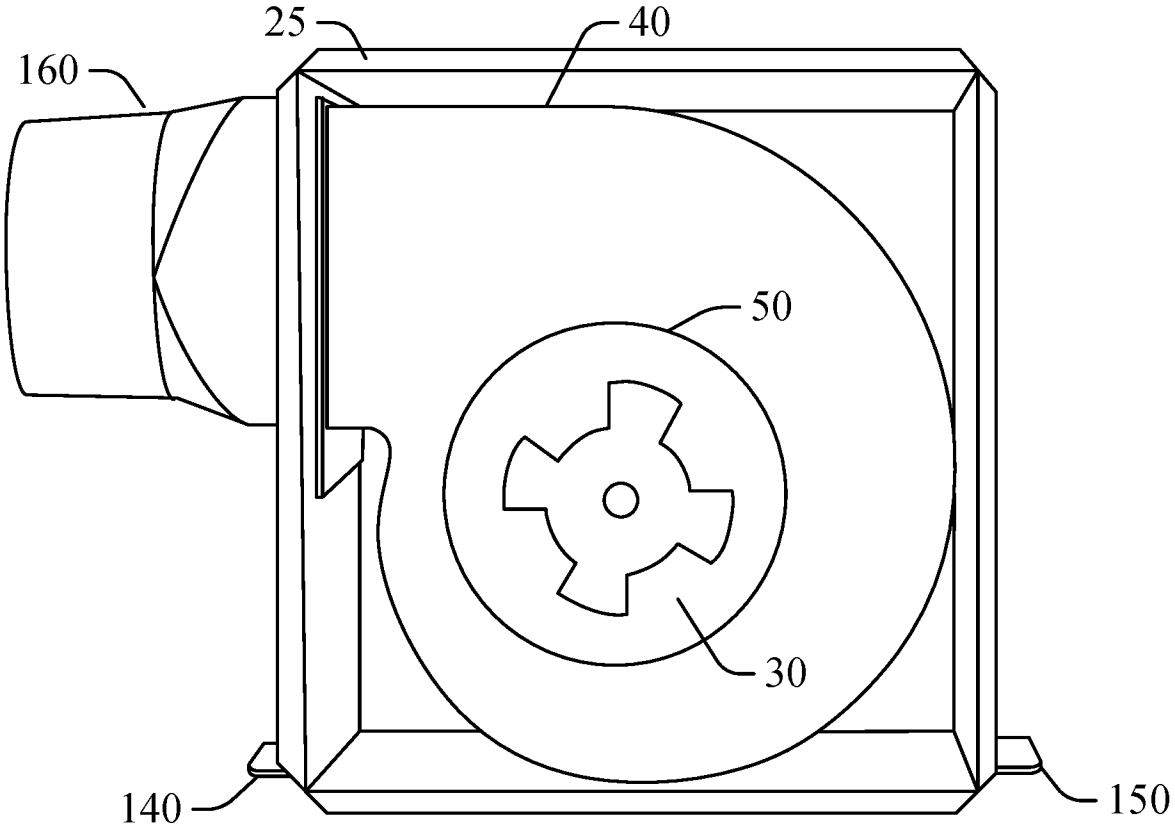
FIG. 3 is a top view of one embodiment of a housing assembly of the ventilation assembly shown in FIGS. 1 and 2 in accordance with one embodiment of the invention.
Figure 6:
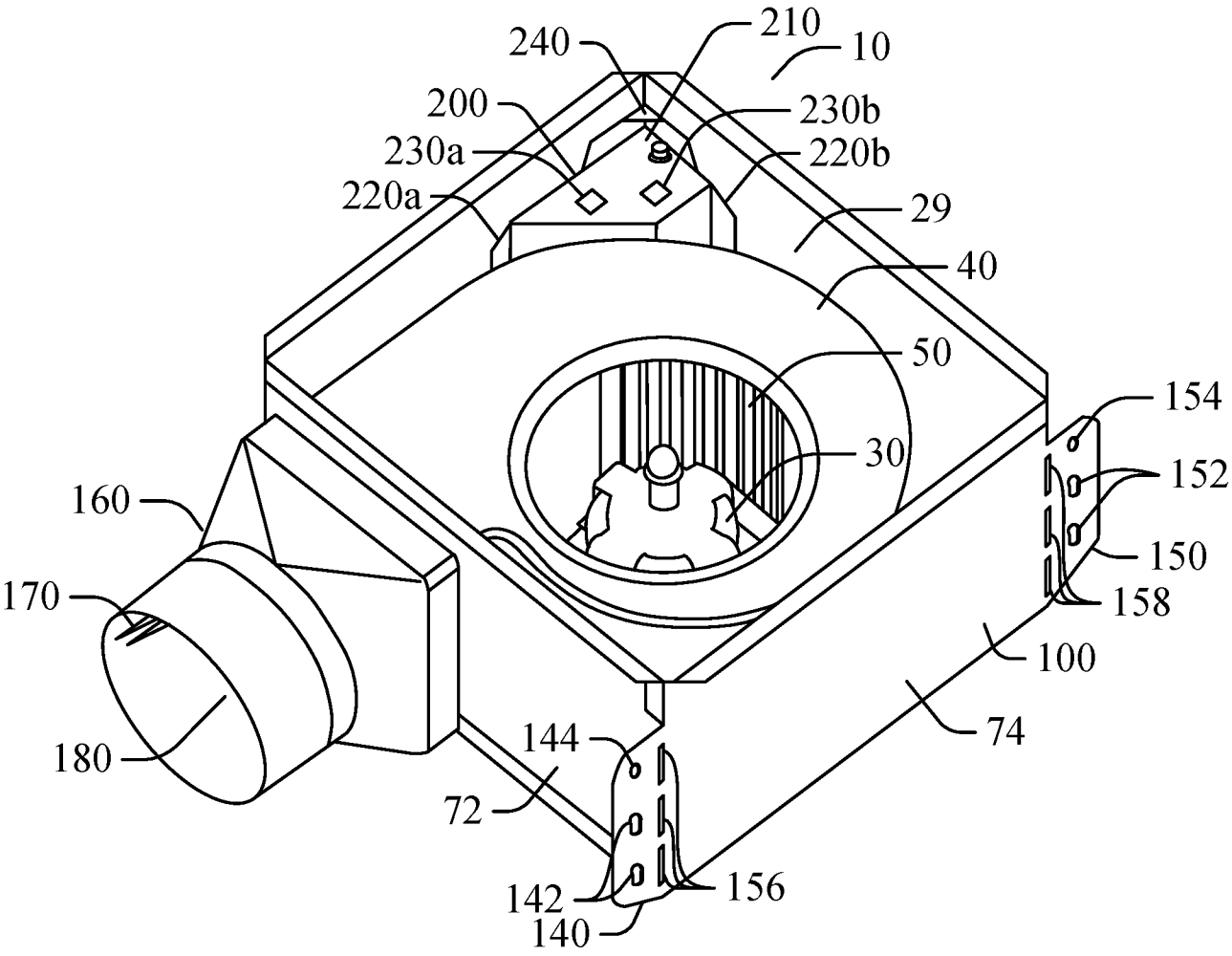
FIG. 6 is a front perspective view of a ventilation assembly shown in FIG. 1 without an installed muffler according to one embodiment of the invention.
Figure 7:
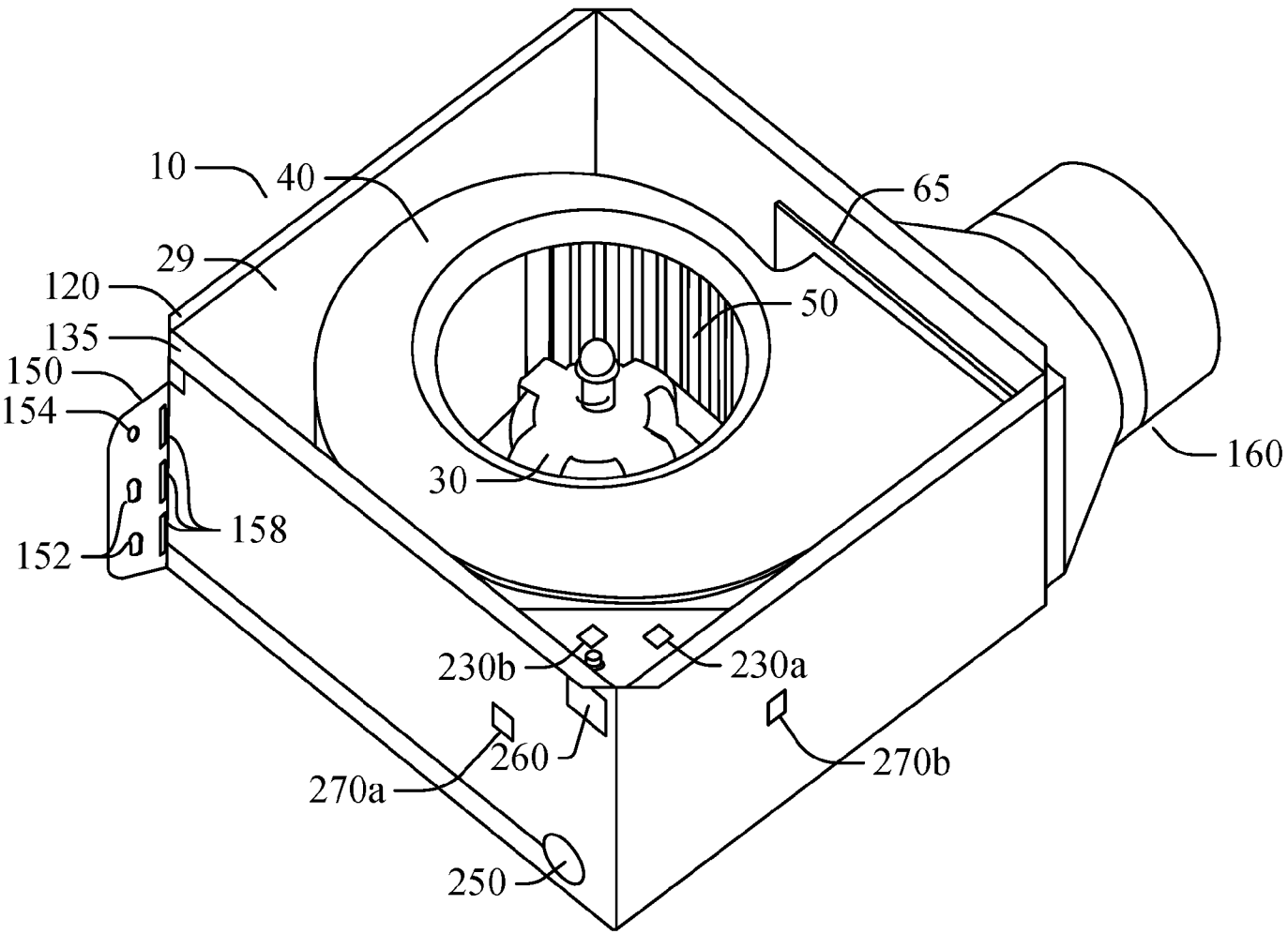
FIG. 7 is a rear perspective view of a ventilation assembly shown in FIG. 2 without an installed muffler according to one embodiment of the invention.

In some embodiments, the ventilation assembly 10 generally can include an exhaust assembly 20, substantially housed within the housing assembly 25, and positioned within the housing assembly 25 and coupled to the main housing assembly with a conventional retention feature such as one or more conventional screws, bolts, rivets, or quick-connect tabs. As shown in FIGS. 3, 6 and 7, in some embodiments, the exhaust assembly 20 generally can include a motor 30. In instances where the motor 30 is a permanent split capacitor motor 30, a conventional motor capacitor can also be housed within the housing assembly 25 (e.g., coupled to the scroll or other component within the main housing 27). Some embodiments can include an exhaust assembly 20 that can comprise a scroll 40 for generating and guiding a fluid flow, and a blower wheel 50 for moving fluid. The blower wheel 50 can be positioned substantially within the scroll 40, and mechanically coupled to the motor 30. In some embodiments, the ventilation assembly 10 can include at least one fluid inlet 60 for receiving fluid from the surrounding environment, and at least one fluid outlet 65 positioned through a first side 72 of the main housing 27 (see FIG. 7). In some embodiments, the fluid inlet 60 provides a pathway for fluid to enter the ventilation assembly 10 through into the blower wheel 50. In some embodiments, fluid can enter the blower wheel 50 and emerge into the scroll 40. In some embodiments, fluid can flow through the scroll 40, and can be discharged from the housing assembly 25 through the ventilation outlet 65. Some embodiments also include one or more components to guide fluid flow into the exhaust assembly 20. For example, as shown in FIGS. 1 and 2, some embodiments include a muffler 85 positioned within and coupled to the housing assembly 25.

Some embodiments of the ventilation assembly 10 can include a coupled a duct connector assembly 160. In some embodiments, the duct connector assembly 160 can include a moveable damper flap 170 coupled within a ventilation orifice 180. In some embodiments, the duct connector assembly 160 coupled with the ventilation orifice 180 and including the moveable damper flap 170 can control the backflow of a fluid into housing assembly 25. For example, in some embodiments, a closed moveable damper flap 170 at least partially covering the ventilation orifice 180 can substantially impede the flow of fluid into the exhaust assembly 20 and the housing assembly 25. Further, in some embodiments, the moveable damper flap 170 can be capable of substantially controlling the flow of fluid from a space, such as a room, into the ventilation duct of a building, or structure, to an outside location.

As illustrated in FIGS. 1 and 2, in some embodiments, the housing assembly 25 can comprise any material which can provide a self-supporting structural support to the assembly 10, while also being able to accommodate varying temperatures and environmental conditions (e.g., to withstand any heat radiated and/or conducted from the motor, or other components). In some embodiments, the housing assembly 25 can be formed of sheet material comprising a relatively high melting temperature. In some embodiments, the housing assembly 25 can be formed from a sheet metal, including, but not limited to an aluminum-based metal, a steel or iron-based metal, a zinc-based metal such as galvanized steel, or a nickel and tin-based metal. In any of the embodiments of the main housing 27 and housing assembly 25 as described, any of the individual or two or more coupled sides 72, 74, 76, 78 can be formed from sheets of metal (e.g., galvanized steel), and joined using a variety of conventional joining techniques include welding, soldering, friction-bonding, crimping, riveting, and screw-attachment and the like. In some embodiments, one or more conventional flanges or tabs can be including in any one of the sides 72, 74, 76, and 78 to allow at least a portion of the sides 72, 74, 76, and 78 to be wrapped and/or coupled to at least one other side 72, 74, 76, and 78. For example, in some embodiments, a first tab 130 (shown in FIG. 1) can be coupled to the first side 72, and a second tab 135 (shown in FIG. 2) can be coupled to a third side 76.

In some other embodiments, the housing assembly 25 can be formed from a polymer-based material, including, but not limited to injection molded polymers, thermo-formed polymers, thermosetting polymers, or any other suitable material. Some embodiments can include a housing assembly 25 that comprises a wood-based product, such as wood, or particle-board or wood laminate. In some other embodiments, the housing assembly 25 can comprise a ceramic or ceramic-composite based product. In some further embodiments, the housing assembly 25 can comprise a glass-fiber or other fiber-reinforced laminate material.

The housing assembly 25 can be formed into any shape, including, but not limited to, a rectangular box-like shape, an oval shape, a hemispherical shape, a spherical shape, a pyramidal shape, or any other shape. The housing assembly 25 can form a base or a similar support structure of the assembly 10. Further, in some embodiments, the housing assembly 25 can provide points and areas of attachment for other components of the system 10, as described in further detail below.

Some embodiments of the invention include at least one mounting apparatus. For example, as shown in FIG. 1, in some embodiments, the ventilation assembly 10 can include a main housing 27 that comprises at least one mounting apparatus 100. In some embodiments for example, a second side 74 of the main housing 27 can include a configurable mounting panel 100 including a main panel 105. In some embodiments, the configurable mounting panel 100 can be used to mount the ventilating system 10 to a surface or a support structure. In some embodiments, the configurable mounting panel 100 can form one side (the second side 74) of the main housing 27. In some embodiments, the mounting panel 100 is coupled with the second side 74. In this instance, the main housing 27 including the second side 74 is formed within the mounting panel 100, and the mounting panel 100 is then secured to the second side 74 (e.g., using rivets or screws, or by welding, or through the use of an adhesive). In some further embodiments, the mounting panel 100 is integral with the main housing 27, and the second side 74 comprises the mounting panel 100.

In some further embodiments, the main housing 27 can be formed from several structural members at least one of which includes the mounting panel 100. For example, in some embodiments, the second side 74 comprising the mounting panel 100 can be coupled with at least one other structural member to form the main housing 27. For example, in some embodiments, a structural member comprising the first, third and fourth sides 72, 76, 78 can be formed and coupled to the second side 74 comprising the mounting panel 100. In some other embodiments, a structural member of the main housing 27 can be formed comprising the second side 74 comprising the mounting panel 100 and at least one other side (e.g., either with the first side 72 or the third side 76 or both) and then coupled to at least one other structural member to form the main housing 27.

Some embodiments of the invention include a mounting panel 100 that comprises at least one mounting flange or tab. For example, in some embodiments, the ventilation assembly 10 can include a main housing 27 that comprises at least one configurable mounting panel 100 that includes first tab 130 and a second tab 135. In some embodiments, either of the first tab 130 and the second tab 135 can be moved relative the housing 27. For example, as shown in FIG. 1, in some embodiments, the first tab 130 can be positioned so as to be substantially flush with the first side 72. Further, as shown in FIG. 2, in some embodiments, the second tab 135 can be positioned substantially flush with the third side 76. In some other embodiments, either of the first tab 130 or the second tab 135 may be positioned extending away from the main housing 27 (i.e., not substantially flush with the sides 72, 76).

In some embodiments, the ventilation assembly 10 can be used to ventilate any room, area or space. Some embodiments include a ventilation assembly 10 that can be secured within or to a wall, ceiling, or other building structure in a partially, or fully recessed position. In some embodiments, the ventilation assembly 10 can be installed within an intermediate space, outside of the room, area or space, and coupled with one or more ventilation duct assemblies to provide ventilation to the room, area or space. In some other embodiments, the fluid may comprise air, or other gases, or vapor, such as water vapor. In some embodiments, the fluid may comprise a smoke, ash, or other particulate in addition to air or other gases.

In some embodiments, the ventilation assembly 10 can be installed as a new, original equipment installation in a room or building where none had previously existed, whereas some embodiments of the invention provide a ventilation assembly 10 that can replace a pre-existing ventilation system. In some embodiments, the exhaust assembly 20, can be installed as a new, or a replacement ventilation system, and in some embodiments, the exhaust assembly 20 can replace an existing exhaust assembly 20.

In some embodiments, the ventilation assembly 10 that can be secured within or to a wall, ceiling, or other building structure using at least one configuration flange portion of the configurable mounting panel 100. For example, as shown in FIGS. 1, 3, and 6, in some embodiments, the configurable mounting panel 100 can include a first configurable flange 140 and a second configurable flange 150, each coupled to and extending outwardly from the main panel 105. Further, in some embodiments, the first configurable flange 140 and the second configurable flange 150 each can extend outwardly from the main housing 27.

Figure 4:
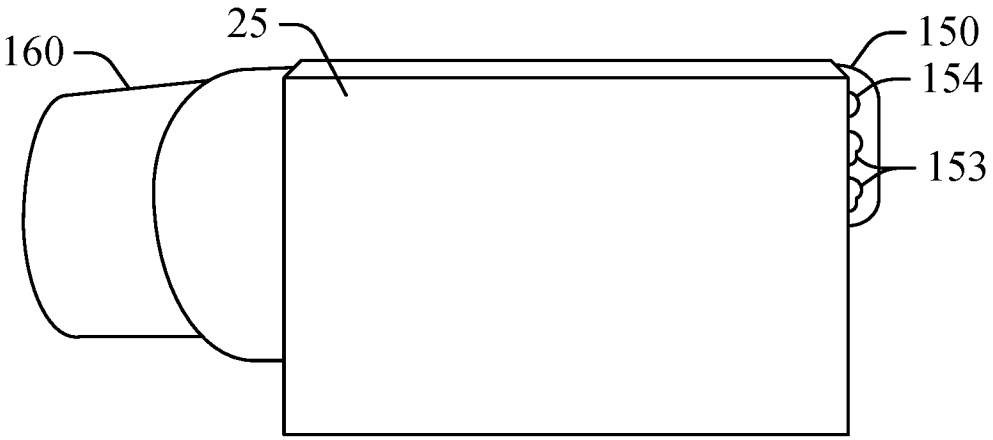
FIG. 4 is a side view of a ventilation assembly according to one embodiment of the invention.
Figure 5:
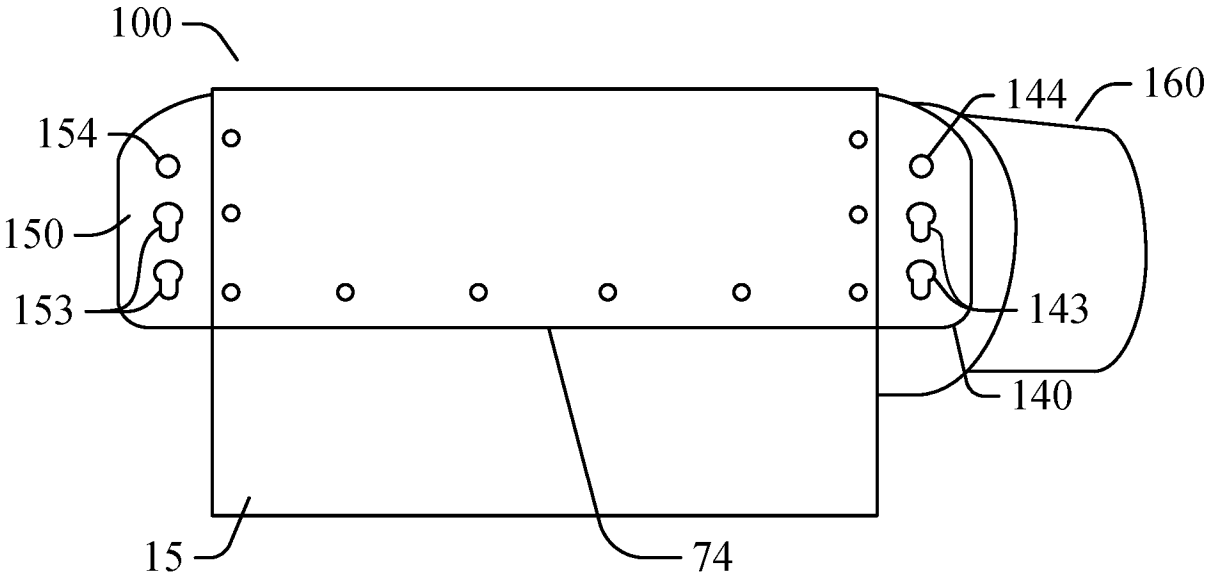
FIG. 5 is a side view showing an opposite side of a ventilation assembly shown in FIG. 4 according to one embodiment of the invention.

In some embodiments, at least one or both of the first configurable flange 140 and the second configurable flange 150 can comprise at least one aperture suitable for use as an attachment region and/or a guiding aid. For example, in some embodiments, the first configurable flange 140 can include mounting apertures 142 and aperture 144, and the second configurable flange 150 can include mounting apertures 152, and an aperture 154. In some other embodiments, the configurable flanges 140, 150 may comprise more or fewer apertures than those shown, and may include one or more apertures that comprise a different shape and/or diameter. For example, FIG. 4 is a side view of a ventilation assembly 10, and FIG. 5 is a side view showing an opposite side of a ventilation assembly 10 shown in FIG. 4 according to one embodiment of the invention. As shown, in some embodiments, the first configurable flange 140 can include a mounting aperture 143, and the second configurable flange 150 can include mounting apertures 153. In some other embodiments, any one of the mounting apertures 142, 152, 143, 153 may have a different shape and/or comprise a plurality of apertures 142, 143.

In some instances during installation, the ventilation assembly 10 may need to be secured to one or more surfaces that are not parallel with the second side 74. In this instance, either the first configurable flange 140 or the second configurable flange 150 can be moved forward or backward by bending and reconfiguring to a new position that allows coupling with one or more surfaces of a building or other structure. As a result of this, either the first configurable flange 140 or the second configurable flange 150 can be moved to a position that is no longer parallel with the second side 74. In some embodiment, the first configurable flange 140 and the second configurable flange 150 can be moved by bending to a new position that results in both the first configurable flange 140 and the second configurable flange 150 being angled from the configurable mounting panel 100 by substantially the same amount or number of degrees. In some other embodiments, the first configurable flange 140 and the second configurable flange 150 can be moved by rotating about the configurable mounting panel 100 by different amounts, thereby resulting in the first configurable flange 140 and the second configurable flange 150 being positioned at different angles from the configurable mounting panel 100.

In some instances, different angles may be necessary to adequately secure the ventilation assembly 10 to a surface that is substantially uneven over a distance spanning the configurable mounting panel 100 from at least the first configurable flange 140 and the second configurable flange 150. Further, in order to accommodate a wide variety of geometries of cavities, walls, ceilings, joists, etc., including instances in which an attachment geometry on one side of the ventilation assembly 10 is different from the opposite side, in some embodiments, from a starting position of the first configurable flange 140 and the second configurable flange 150 being parallel with the second surface 74, either or both of the first configurable flange 140 and the second configurable flange 150 can be rotated inward (towards the main housing 27) to any angle by up to about 90°. In some further embodiments, from a starting position of the first configurable flange 140 and the second configurable flange 150 being parallel with the second surface 74, either or both of the first configurable flange 140, and the second configurable flange 150, can be rotated inward (towards the main housing 27) to any angle up to about 270°.

In some embodiments, at least the first configurable flange 140 or the second configurable flange 150 can include features to facilitate rotation on the configurable mounting panel 100. In some embodiments, the mounting panel 100 can include bending regions of reduced thickness within a region of the main panel 105 coupled to the first configurable flange 140 and the second configurable flange 150. For example, in some embodiments, material forming the mounting panel 100 can comprise a reduced thickness and/or reduce tensile strength in a bending region 140*a* adjacent to the first configurable flange 140, or within a bending region 150*a* adjacent to the second configurable flange 150. In some embodiments, when either of the regions 140*a* 150*a* comprises a reduce thickness and/or reduced tensile strength, the adjacent first configurable flange 140 and the second configurable flange 150 can be moved (i.e., rotated) about the mounting panel 100 with a lower force, thereby facilitating ease of movement of the flanges 140, 150 by a user. In some further embodiments, the regions 140*a* and/or 150*a* can include one or more apertures. For example, in some embodiments the bending region 140*a* can include a plurality of bending slots 156 and the bending region 150*a* can include a plurality of bending slots 158 (shown in FIGS. 1 and 2 for example). In some embodiments, when either of the regions 140*a*, 150*a* comprise at least one aperture (i.e., the bending slots 156, 158), the adjacent first configurable flange 140 and second configurable flange 150 can be moved (i.e., rotated) about the mounting panel 100 with a lower force (due in part to the reduction total volume of material within the bending regions 140*a*, 150*a* which comprise regions of where a bending force is applied). In some embodiments, the regions 140*a* and 150*a* can each include three apertures. As shown in the examples illustrated in FIGS. 1 and 2, each of the bending slots 156, 158 can comprise three apertures. In some other embodiments, the regions 140*a*, 150*a* can include more or less numbers of apertures shown in bending slots 156, 158, or apertures with different geometry.

Some embodiments can also include other flange structures. For example, in some embodiments, the housing assembly 25 can comprise a main housing 27 that includes a mounting flange 120. In some embodiments, the mounting flange 120 can facilitate coupling the ventilation assembly 10 to a surface (e.g., a ceiling, wall or joist).

The assembly 10 can generally include electrical connections and various wiring components to support powering of one or more components of the assembly 10 including the motor 30. For example, in some embodiments, the housing assembly 25 can include at least one electrical box enclosure 200. The electrical box enclosure 200 can serve to house various wiring and electrical components, and can serve to route power into the ventilation assembly 10, and to provide a power supply point for coupling various components of the assembly 10, including the motor 30.

In some embodiments, an electrical box enclosure 200 can provide a source of electrical power to the motor 30 and any conventional capacitor. For example, some embodiments of the invention can include an electrical box enclosure 200 coupled with the main housing 27. In some embodiments, when the housing assembly 25 is manufactured or installed, an electrical box enclosure 200 can positioned and coupled to an inner region 29 of a main housing 27. In some embodiments, the electrical box enclosure 200 can positioned and coupled to an inner region 29 of a main housing 27 by coupling to at least the third side 76, the fourth side 78, or both. For example, FIG. 6 shows a front perspective view of a ventilation assembly shown in FIG. 1 (without an installed muffler 85), and FIG. 7 is a rear perspective view of a ventilation assembly shown in FIG. 2 without an installed muffler 85 according to one embodiment of the invention. In some embodiments, the enclosure 200 can include anchoring flanges 220*a*, 220*b* that can be used with a fastener (not shown) to secure the electrical box enclosure 200 to the main housing assembly 25. For example, in some embodiments, at least a portion of the anchoring flange 220*a* can be secured to the third side 76, and at least a portion of the anchoring flange 220*b* can be secured to the fourth side 78.

In some embodiments, the electrical box enclosure 200 can comprise an electrical box cover plate 210. In some embodiments, the electrical box enclosure 200 can include a cover plate 210 that can be moved, and/or pivoted, and/or rotated to provide access to the inside of the electrical box enclosure 200. In some embodiments, the electrical box enclosure 200 can comprise a swing-action type electrical box cover plate 210 including a fastening screw 210*b* and a lifting tab 240. In some embodiments, the electrical box cover plate 210 can be pivoted about an edge 210*a* following loosening and removal of the screw 210*b*, and raising of the cover plate 210 by applying a lifting force to the lifting tab 240.

In some embodiments, the electrical box enclosure 200 includes a power receptacle 230*a*, 230*b*. In some embodiments, power can be fed into the electrical box enclosure 200 through at least one wiring aperture 250 (shown in FIG. 7). In some embodiments, when the ventilation assembly 10 is installed, the electrical box enclosure 200 can be coupled with an electrical power supply through the at least one wiring aperture 250. Further, as illustrated, in some embodiments, the ventilation assembly 10 can also include an access tab 260. In some embodiments, the access tab 260 can allow convenient access to the electrical box enclosure 200, and in some further embodiments, other access apertures 270*a*, 270*b* can also be provided.

Figure 8A:
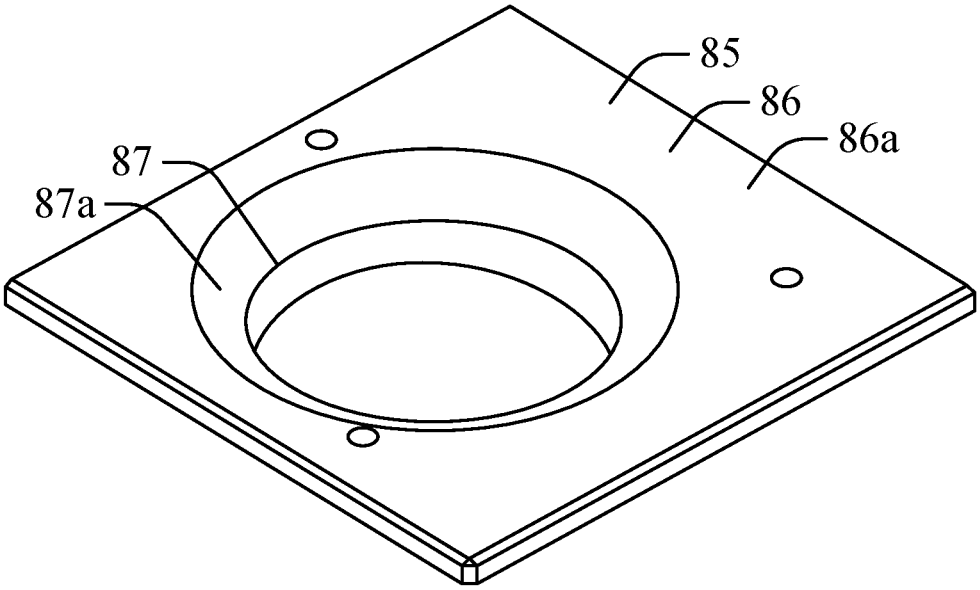
FIG. 8A shows a top perspective view of a muffler shown installed in the ventilation assembly of FIGS. 1 and 2 according to one embodiment of the invention.
Figure 8B:
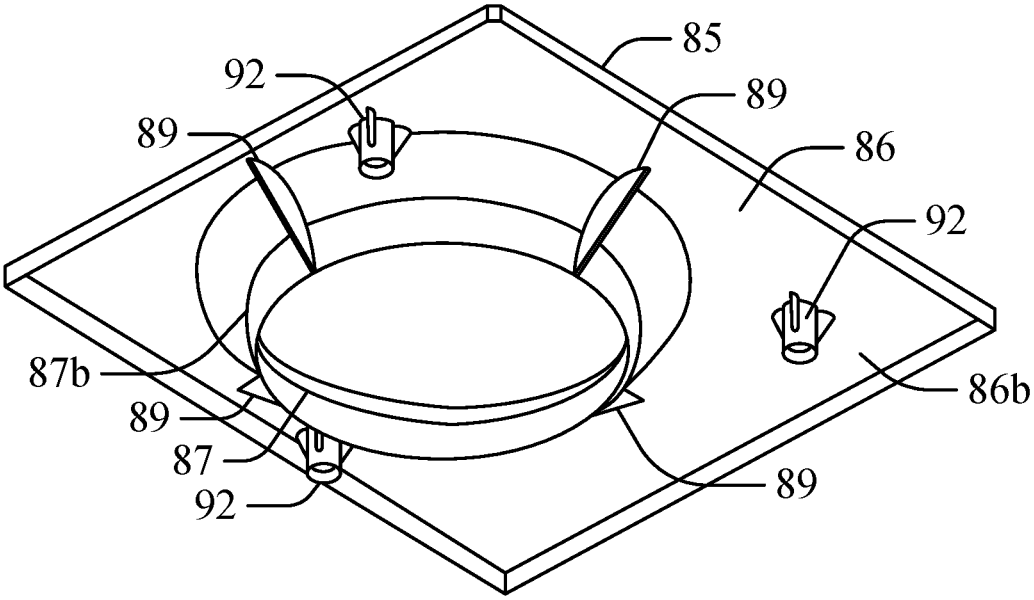
FIG. 8B shows a bottom perspective view of a muffler shown installed in the ventilation assembly of FIGS. 1 and 2 according to one embodiment of the invention.

As described earlier, in some embodiments, fluid can enter the assembly 10 and flow through the scroll 40 after entering the ventilation inlet 60 through a muffler 85 (shown for example in in FIGS. 1 and 2. FIG. 8A shows a top perspective view of a muffler shown installed in the ventilation assembly of FIGS. 1 and 2, and FIG. 8B shows a bottom perspective view of a muffler shown installed in the ventilation assembly of FIGS. 1 and 2 according to one embodiment of the invention. As illustrated, the muffler 85 can comprise a top panel 86 that includes a muffler aperture 87 formed within top panel 86 including an outer periphery of the aperture that comprises a substantially convex surface 87*a* in the top side 86*a* (FIG. 8A) and a substantially concave surface 87*b* in the bottom side 86*b* (FIG. 8B). Further, some embodiments can include a plurality of structural ridges 89 coupled to the substantially concave surface 87*b* in the bottom side 86*b* to provide structural support to the muffler 85. In some embodiments, the muffler can also include a plurality of fastening mounts 92. In some embodiments, the muffler 85 can be coupled to the exhaust assembly 25 and the main housing assembly 25 using the fastening mounts 92, for example using one or more screws, bolts or other conventional fasteners (not shown).

In some embodiments, the dimensions of the housing assembly 25 enable the fully assembled ventilation assembly 10 to be maneuvered and installed within a standard 2'×4' wall structure. In some embodiments, the ventilation assembly 10 can be installed as a new, original equipment installation in a room or building where none had previously existed, whereas some embodiments of the invention provide a ventilation assembly 10 that can replace a pre-existing ventilation system. In some embodiments, the ventilation assembly 10 can be installed as a new ventilation assembly 10 or as a replacement of an older and/or previously existing ventilation apparatus. For example, in some embodiments, an installer can maneuver the ventilation assembly 10 directly into a cavity or aperture of a structure where no ventilation apparatus had previously existed, or to replace an existing ventilation apparatus that has been previously removed from the cavity or aperture of a structure.

The invention claimed is:

1. A ventilation apparatus, comprising:

a housing assembly including a main housing comprising a plurality of side walls including at least a first side wall coupled to a second side wall at an edge to at least partially enclosing an inner region, the housing assembly including at least one fluid inlet for receiving fluid from a surrounding environment, and at least one fluid outlet positioned through the first side wall of the main housing, wherein at least one of the side walls comprises a tab;

an exhaust fan assembly coupled to the housing assembly within the inner region, the exhaust fan assembly comprising a scroll positioned within and coupled to the main housing, and a blower wheel positioned within the scroll and mechanically coupled to a motor and capable of generating a fluid flow within the scroll;

a configurable mounting panel comprising:

a main panel configured to be positioned-against at least one of the plurality of side walls of the main housing such that the main panel is integral to the at least one of the plurality of side walls, at least one configurable flange coupled to the main panel and extending outwardly from the main panel, and at least one bending region coupled between the main panel and the at least one configurable flange, wherein the at least one bending region comprises at least one aperture and is positioned proximate the edge permitting deflection of the at least one configurable flange relative to the main panel around the edge.

2. The ventilation apparatus of claim 1, further comprising a muffler including a muffler aperture, the muffler positioned within and coupled to the housing assembly.

3. The ventilation apparatus of claim 2, wherein the muffler includes a top panel top side, a bottom side and an outer periphery region around the muffler aperture, the outer periphery region comprising a substantially convex surface on the top side and a substantially concave surface on the bottom side.

4. The ventilation apparatus of claim 2, wherein the muffler further includes a plurality of structural ridges coupled to the substantially concave surface in the bottom side.

5. The ventilation apparatus of claim 2, wherein the muffler further includes a plurality of fastening mounts, the plurality of fastening mounts configured and arranged to couple the muffler to the exhaust assembly and the main housing.

6. The ventilation apparatus of claim 1, wherein the configurable mounting panel is coupled to the second side wall.

7. The ventilation apparatus of claim 1, wherein the second side wall comprises the configurable mounting panel.

8. The ventilation apparatus of claim 1, wherein the configurable mounting panel includes at least one mounting aperture.

9. The ventilation apparatus of claim 1, wherein the configurable mounting panel includes a first configurable flange and a second configurable flange.

10. The ventilation apparatus of claim 9, wherein the first configurable flange and the second configurable flange each comprise at least one mounting aperture.

11. The ventilation apparatus of claim 10, wherein the first configurable flange and the second configurable flange each further comprise an aperture.

12. The ventilation apparatus of claim 1, further comprising at least one electrical box enclosure.

13. The ventilation apparatus of claim 12, wherein the at least one electrical box enclosure includes at least two anchoring flanges; and wherein the electrical box enclosure is secured to the housing assembly by a first anchoring flange coupling with a third side wall of the main housing, and a second anchoring flange coupling with a fourth side wall of the main housing.

14. The ventilation apparatus of claim 12, wherein the at least one electrical box enclosure includes an electrical box cover plate.

15. The ventilation apparatus of claim 14, wherein the electrical box cover plate is secured to the electrical box enclosure using at least one screw.

16. The ventilation apparatus of claim 15, wherein the electrical box cover plate further comprises a lifting tab.

17. The ventilation apparatus of claim 16, wherein the electrical box cover plate can be at least partially opened by pivoting the plate about an edge by applying a lifting force to the lifting tab following loosening and removal of the screw.

18. The ventilation apparatus of claim 1, further comprising a duct connector assembly coupled to the first side wall of the main housing.

19. A ventilation apparatus, comprising:

a housing assembly including at least one fluid inlet for receiving fluid from a surrounding environment and a main housing comprising at least a first side wall coupled to a second side wall at an edge, wherein the housing assembly comprises a configurable mounting panel, wherein at least one of the side walls comprises a tab;

a fluid outlet positioned through the first side wall of the main housing;

an exhaust fan assembly comprising a scroll positioned within and coupled to the main housing, and a blower wheel positioned within the scroll and mechanically coupled to a motor and capable of generating a fluid flow within the scroll and fluid discharge through the fluid outlet; and a muffler including an aperture, the muffler positioned within and coupled to the housing assembly;

wherein the configurable mounting panel comprises:

a main panel configured to be positioned against the second side wall such that the main panel is integral to the at least one of the plurality of side walls, at least one configurable flange coupled to and extending outwardly from the main panel, and at least one bending region coupled between the main panel and the at least one configurable flange, wherein the at least one bending region comprises at least one aperture and is positioned proximate the edge permitting deflection of the at least one configurable flange relative to the main panel around the edge.

20. The ventilation apparatus of claim 19, further comprising an electrical box enclosure coupled within the main housing and a duct connector assembly coupled to the first side wall.

* * * * *